US008292416B2

(12) United States Patent
Kihira et al.

(10) Patent No.: US 8,292,416 B2
(45) Date of Patent: Oct. 23, 2012

(54) INKJET PRINTER HEAD

(75) Inventors: Takakazu Kihira, Kanagawa (JP); Yukitoshi Tajima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 318 days.

(21) Appl. No.: 12/815,748

(22) Filed: Jun. 15, 2010

(65) Prior Publication Data

US 2010/0315471 A1 Dec. 16, 2010

(30) Foreign Application Priority Data

Jun. 16, 2009 (JP) ..... 2009-143019

(51) Int. Cl.
*B41J 2/175* (2006.01)

(52) U.S. Cl. ..... 347/85; 347/71; 347/72

(58) Field of Classification Search ..... 347/85, 347/70, 71, 72; 310/365
See application file for complete search history.

(56) References Cited

U.S. PATENT DOCUMENTS 5,748,214 A * 5/1998 Usui et al. ..... 347/70
6,802,597 B2 * 10/2004 Furuhata ..... 347/71
6,820,969 B2 * 11/2004 Miyata ..... 347/71
6,840,601 B2 * 1/2005 Miyata ..... 347/70
7,239,070 B2 * 7/2007 Shimada et al. ..... 310/365

FOREIGN PATENT DOCUMENTS

| | | |
|---|---|---|
| JP | 2003-182076 | 7/2003 |
| JP | 2004-34293 | 2/2004 |
| JP | 2004-148813 | 5/2004 |
| JP | 2006-102980 | 4/2006 |
| JP | 2006-116767 | 5/2006 |
| JP | 2007-118312 | 5/2007 |
| JP | 2007-145014 | 6/2007 |
| JP | 2008-37099 | 2/2008 |

* cited by examiner

*Primary Examiner* — Ellen Kim
(74) *Attorney, Agent, or Firm* — Oblon, Spivak, McClelland, Maier & Neustadt, L.L.P.

(57) ABSTRACT

An inkjet printer head includes a nozzle plate having nozzles for jetting ink; a flow path plate having flow paths for communicating with the nozzles, each of the flow paths including a pressure chamber and a resistance part having a smaller cross-sectional area than the pressure chamber, wherein piezoelectric elements having smaller horizontal areas than the flow paths are laminated on the flow path plate; and a common liquid chamber configured to guide the ink from an opening to the pressure chamber. The common liquid chamber is formed by a first member and a second member. The first member forms a top part of the common liquid chamber, and the second member forms a side surface and a bottom surface of a bottom part of the common liquid chamber by adhering to an outer wall of the first member and to an ink jetting surface of the nozzle plate.

5 Claims, 7 Drawing Sheets

INKJET PRINTER HEAD

BACKGROUND OF THE INVENTION

1. Field of the Invention

The present invention relates to inkjet printer heads used in image recording apparatuses.

2. Description of the Related Art

Inkjet printer heads functioning as liquid droplet jetting heads are used in image recording apparatuses such as printers, fax machines, and copiers, or in inkjet recording apparatuses used as image forming apparatuses. An inkjet printer head includes nozzles for jetting ink droplets, flow paths (liquid chambers) for communicating with the nozzles, and a pressure generating unit such as a piezoelectric element for generating pressure to be applied to the ink in the flow paths. Ink droplets are jetted from the nozzles by generating pressure with the pressure generating unit and applying the pressure to the ink in the liquid chambers.

In conventional inkjet printer heads, the respective liquid chambers and a common liquid chamber for communicating with the liquid chambers are made of materials such as photosensitive resin, resin mold, metal, and glass. However, liquid chambers made of resin have low rigidity, and therefore crosstalk is likely to occur between liquid chambers that are close to each other. Thus, good image quality may not be achieved. Meanwhile, liquid chambers made of metal and glass have high rigidity, but are difficult to fabricate. Thus, there may be difficulty in responding to demand for high density products to achieve high quality images.

There are proposals for forming liquid chambers and common liquid chambers by performing anisotropic etching on a silicon substrate (silicon wafer). Specifically, silicon flow path plates, which are used for forming liquid chambers, are fabricated as follows. On a silicon substrate (silicon wafer), liquid chambers and common liquid chambers corresponding to plural head chips are formed. Then, the silicon substrate (silicon wafer) is divided into plural flow path plates in accordance with the respective chips. If only a small number of flow path plates can be obtained from the silicon wafer (by dividing the silicon wafer), costs for fabricating flow path plates would increase.

In the inkjet recording heads disclosed in patent documents 1 to 4, the width of the flow path plate corresponds to the length between peripheral edges of the frame. Therefore, the width of the flow path plate cannot be reduced. In the inkjet recording heads disclosed in patent documents 5 to 8, a pressure attenuating mechanism (membrane, damper chamber) is disposed away from the common liquid chamber, and therefore the pressure attenuating mechanism has limited efficiency. Furthermore, in order to incorporate the mechanism in the recording head, the size of the recording head needs to be increased.

FIG. 2 is a cross-sectional side view of a conventional inkjet recording head. In the inkjet recording head, the outer walls of a frame 20, an oscillating plate 17, a flow path plate 10, and a nozzle plate 14 are aligned along the same plane (as indicated by each arrow on either side of the inkjet printer head). Thus, a width 33 of a common liquid chamber 30 and a margin to adhere 44 are wide, on either side of (left and right) the inkjet recording head. Accordingly, the flow path plate 10 has a wide width. Therefore, only a small number of flow path plates 10 can be obtained from a silicon wafer (by dividing silicon wafer). Consequently, high costs may be required for fabricating flow path plates.

Patent Document 1: Japanese Laid-Open Patent Application No. 2006-116767

Patent Document 2: Japanese Laid-Open Patent Application No. 2004-34293

Patent Document 3: Japanese Laid-Open Patent Application No. 2004-148813

Patent Document 4: Japanese Laid-Open Patent Application No. 2003-182076

Patent Document 5: Japanese Laid-Open Patent Application No. 2007-145014

Patent Document 6: Japanese Laid-Open Patent Application No. 2006-102980

Patent Document 7: Japanese Laid-Open Patent Application No. 2008-37099

Patent Document 8: Japanese Laid-Open Patent Application No. 2007-118312

SUMMARY OF THE INVENTION

The present invention provides an inkjet printer head, in which one or more of the above-described disadvantages are eliminated.

A preferred embodiment of the present invention provides an inkjet printer head with which an increased number of flow path plates can be obtained from a silicon wafer, so that the inkjet printer head can be manufactured with a high yield ratio.

According to an aspect of the present invention, there is provided an inkjet printer head including a nozzle plate in which plural nozzles for jetting ink are formed; a flow path plate in which flow paths for communicating with the plural nozzles are formed, each of the flow paths including a pressure chamber and a flow path resistance part having a smaller cross-sectional area than the pressure chamber, wherein piezoelectric elements are laminated on the flow path plate, each of the piezoelectric elements having an area that is less than or equal to a horizontal cross-sectional area of each of the flow paths; and a common liquid chamber configured to guide the ink from an ink supply opening to the pressure chamber, wherein the common liquid chamber is formed by a first common liquid chamber forming member and a second common liquid chamber forming member, the first common liquid chamber forming member forming a top part of the common liquid chamber, and the second common liquid chamber forming member forming a side surface and a bottom surface of a bottom part of the common liquid chamber by adhering to an outer wall of the first common liquid chamber forming member and to an ink jetting surface of the nozzle plate.

According to one embodiment of the present invention, an inkjet printer head is provided, with which an increased number of flow path plates can be obtained from a silicon wafer, so that the inkjet printer head can be manufactured with a high yield ratio.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

Figure 1:
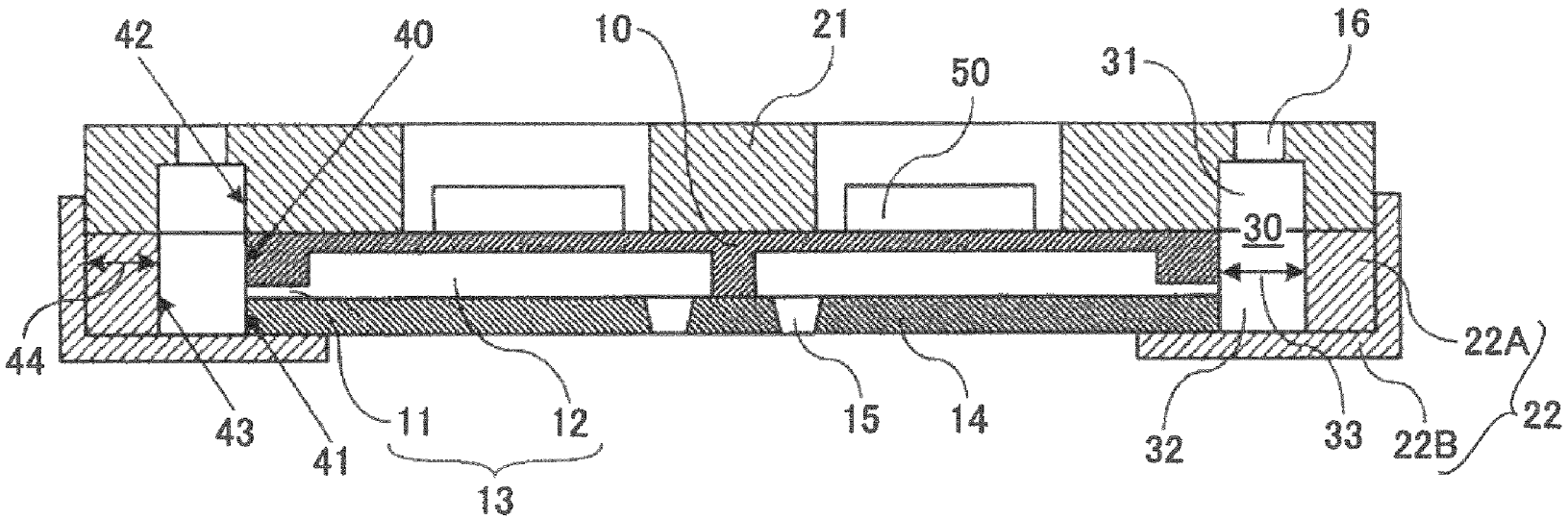
FIG. 1 is a cross-sectional view of an inkjet printer head according to an embodiment of the present invention.
Figure 2:
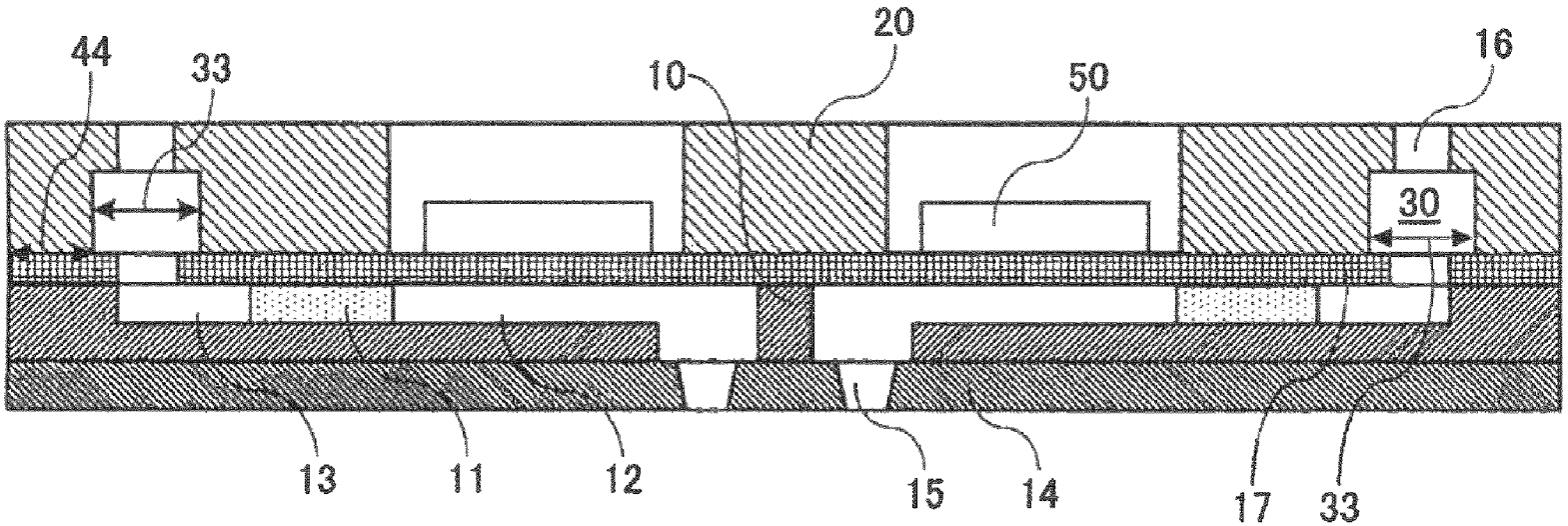
FIG. 2 is a cross-sectional view of a conventional inkjet recording head.

FIG. 1 is a cross-sectional view of an inkjet printer head according to an embodiment of the present invention.

The inkjet printer head includes a nozzle plate 14, a flow path plate 10, and common liquid chambers 30. The nozzle plate 14 has plural nozzles 15 for jetting ink. The flow path plate 10 has flow paths 13 for communicating with the nozzles 15. Each of the flow paths 13 includes a pressure chamber 12 and a flow path resistance part 11 that has a smaller cross-sectional area than the pressure chamber 12. Furthermore, piezoelectric elements 50 are laminated on the flow path plate 10. Each of the piezoelectric elements 50 has an area that is less than or equal to the horizontal cross-sectional area of each flow path 13. Each of the common liquid chambers 30 is for guiding ink from an ink supply opening 16 to the pressure chambers 12. The common liquid chambers 30 are formed by a first common liquid chamber forming member 21 and a second common liquid chamber forming member 22. The first common liquid chamber forming member 21 forms a top part of each of the common liquid chambers 30 (hereinafter, "common liquid chamber top part 31"). The second common liquid chamber forming member 22 forms the side surface and the bottom surface of a bottom part of each of the common liquid chambers 30 (hereinafter, "common liquid chamber bottom part 32"), by adhering to the outer walls of the first common liquid chamber forming member 21 and the ink jetting surface of the nozzle plate 14 (the surface of the nozzle plate 14 from which ink is jetted).

The second common liquid chamber forming member 22 includes a member 22A and a member 22B. The member 22A forms a side surface of the common liquid chamber bottom part 32 and the member 22B forms the bottom surface of the common liquid chamber bottom part 32. The height of the member 22A that forms the side surface of the common liquid chamber bottom part 32 is equal to the total thickness of the flow path plate 10 and the nozzle plate 14 that are laminated to each other.

An inner surface 42 of the common liquid chamber top part 31, which is fromed by the first common liquid chamber forming member 21; an outer wall 40 of the flow path plate 10; and an an outer wall 41 of the nozzle plate 14, are aligned along the same plane. Furthermore, the flow path resistance parts 11, which are provided at the outer edges of the flow path plate 10, are directly communicating with the common liquid chamber bottom part 32. Accordingly, the widths of the nozzle plate 14 and the flow path plate 10 can be reduced by an amount corresponding to the width of each common liquid chamber 30 (hereinafter, "common liquid chamber width 33") and a margin to adhere 44 on either side of (left and right) the inkjet printer head.

Among the members of the second common liquid chamber forming member 22, the member 22A, which forms the side surface of the common liquid chamber bottom part 32, forms an inner wall 43 of the common liquid chamber bottom part 32, the inner wall 43 being on the outer side of the common liquid chamber bottom part 32 (the side facing the outside of the inkjet printer head).

On either side of the inkjet printer head shown in FIG. 1, the outer walls of the flow path plate 10 and the nozzle plate 14 are formed on the same plane as the inner wall of the common liquid chamber 30. Therefore, the widths of the flow path plate 10 and the nozzle plate 14 can be reduced by 40% through 45% with respect to a conventional configuration.

The member 22B forming the bottom surface of the common liquid chamber bottom part 32 forms the bottom surface of the common liquid chamber 30 (including the common liquid chamber top part 31 and the common liquid chamber bottom part 32). The ink supplied from the ink supply opening 16 passes through the common liquid chamber top part 31, the common liquid chamber bottom part 32, and the flow path resistance parts 11, and then enters the pressure chambers 12. A voltage applying unit applies a voltage to the piezoelectric elements 50, which are disposed on the flow path plate 10 on the side opposite to the pressure chambers 12, to excite oscillation of the piezoelectric elements 50. Accordingly, the volume of the pressure chamber 12 changes, and ink droplets are jetted from the nozzles 15 provided in the nozzle plate 14.

Figure 3:
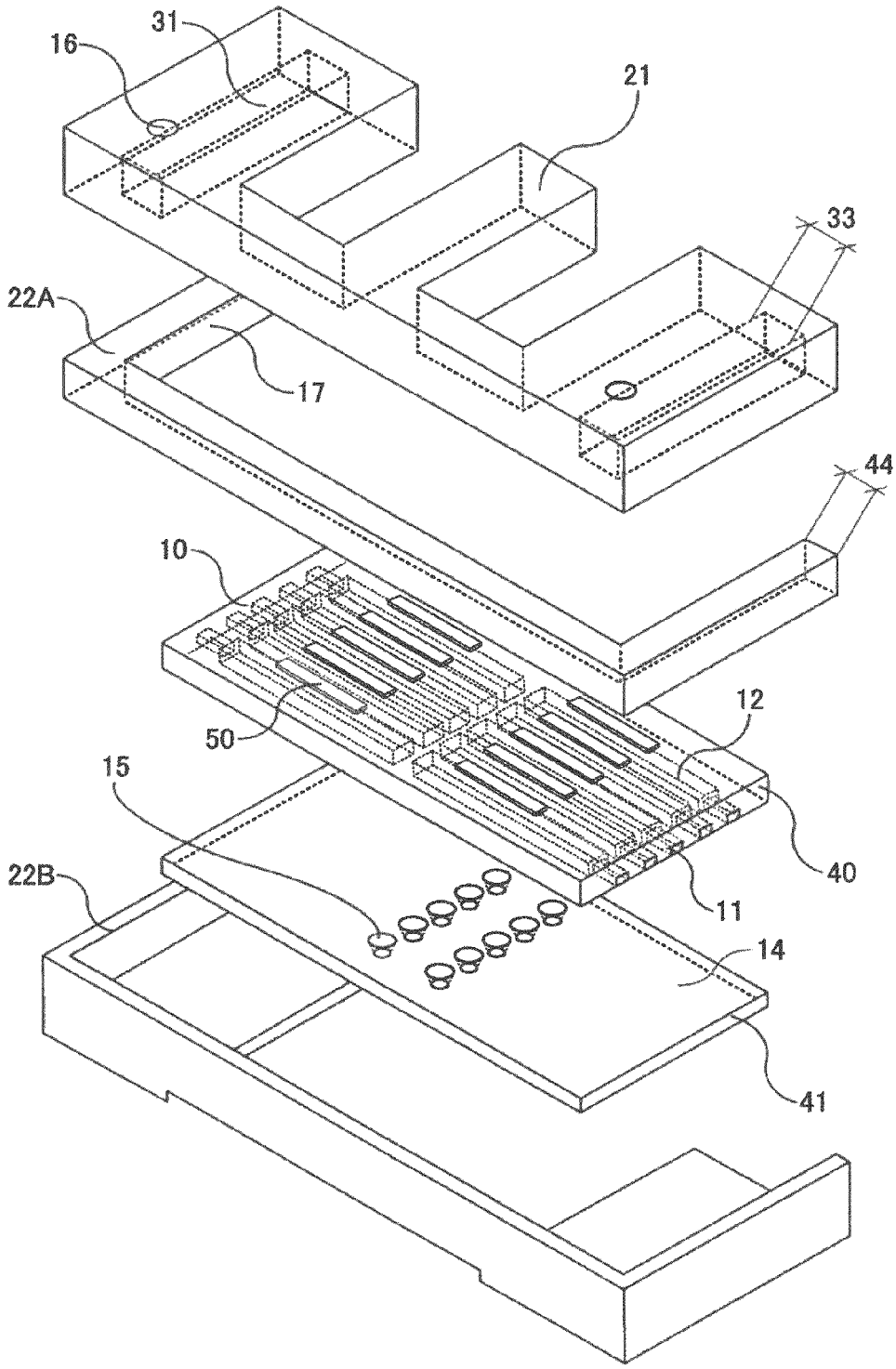
FIG. 3 is a perspective exploded view of components of the inkjet printer head shown in FIG. 1, which are shown separately in the order of lamination.

FIG. 3 is a perspective exploded view of components of the inkjet printer head shown in FIG. 1, which are shown separately in the order of lamination. Specifically, the common liquid chamber top part 31, the member 22A forming the side surfaces of the second common liquid chamber forming member 22, the flow path plate 10, the nozzle plate 14, and the member 22B forming the bottom surface of the second common liquid chamber forming member 22, are shown from the top in the stated order. The inner walls of the common liquid chambers 30 on the outer side (the side facing the outside of the inkjet printer head) are formed with a member (member 22A) other than the flow path plate 10. Therefore the width of the flow path plate 10 can be reduced.

Figure 4:
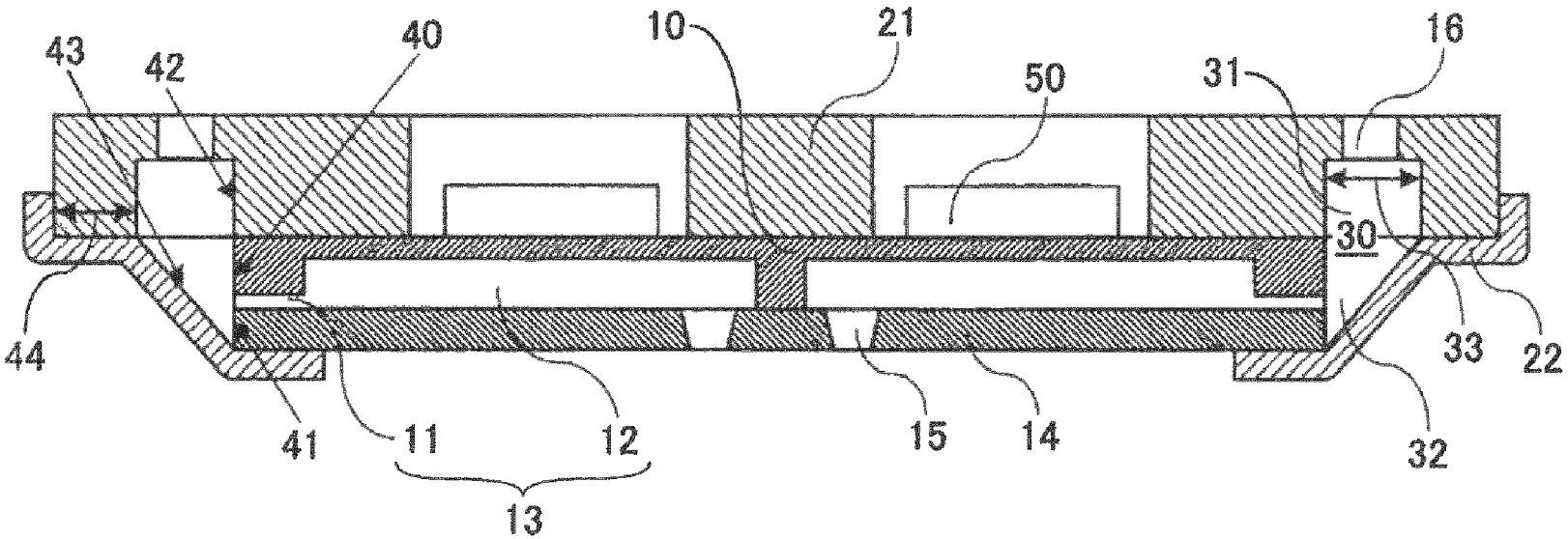
FIG. 4 is a cross-sectional view of the inkjet printer head according to another embodiment of the present invention.
Figure 5:
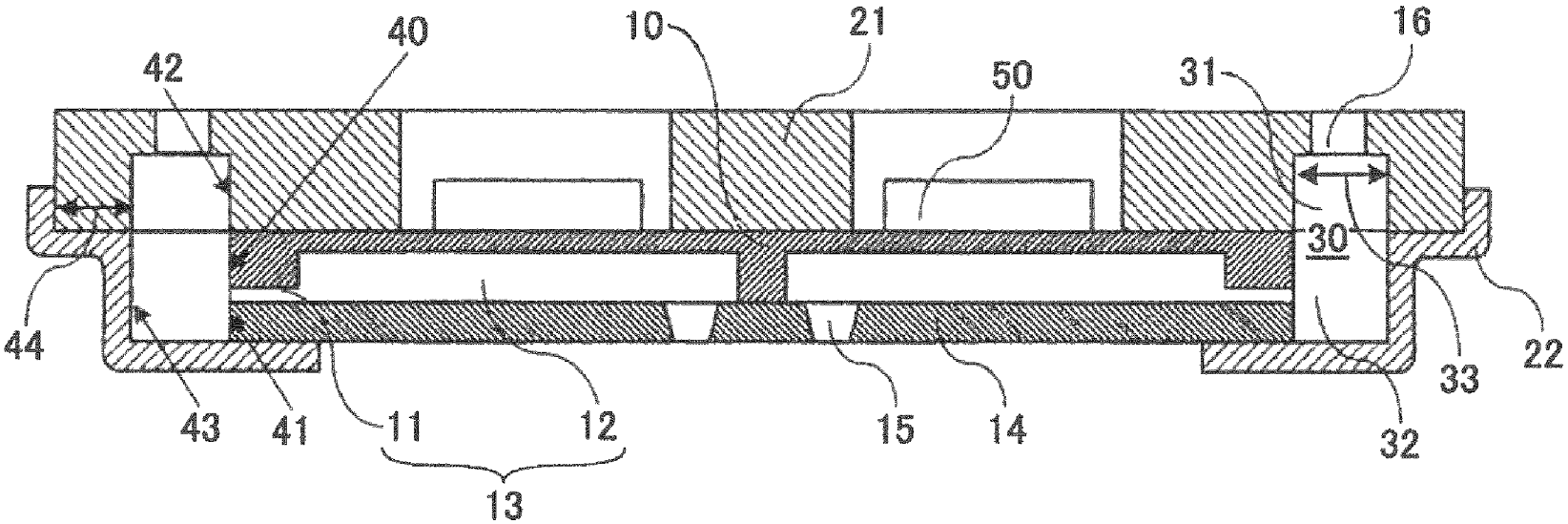
FIG. 5 is a cross-sectional view of the inkjet printer head according to yet another embodiment of the present invention.

FIGS. 4 and 5 are cross-sectional views of the inkjet printer heads according to another embodiment of the present invention. In this embodiment, the second common liquid chamber forming member 22 is forming the side surface and the bottom surface of the common liquid chamber bottom part 32 with a single member.

The common liquid chambers 30 are disposed at the edge parts on either side of the nozzle plate 14 and the flow path plate 10, i.e., on the outermost peripheral edges of the inkjet printer head. The common liquid chambers 30, the flow path resistance parts 11, and the pressure chambers 12 are serially arranged along the same plane, and therefore the width of the flow path plate 10 can be reduced.

Figure 6:
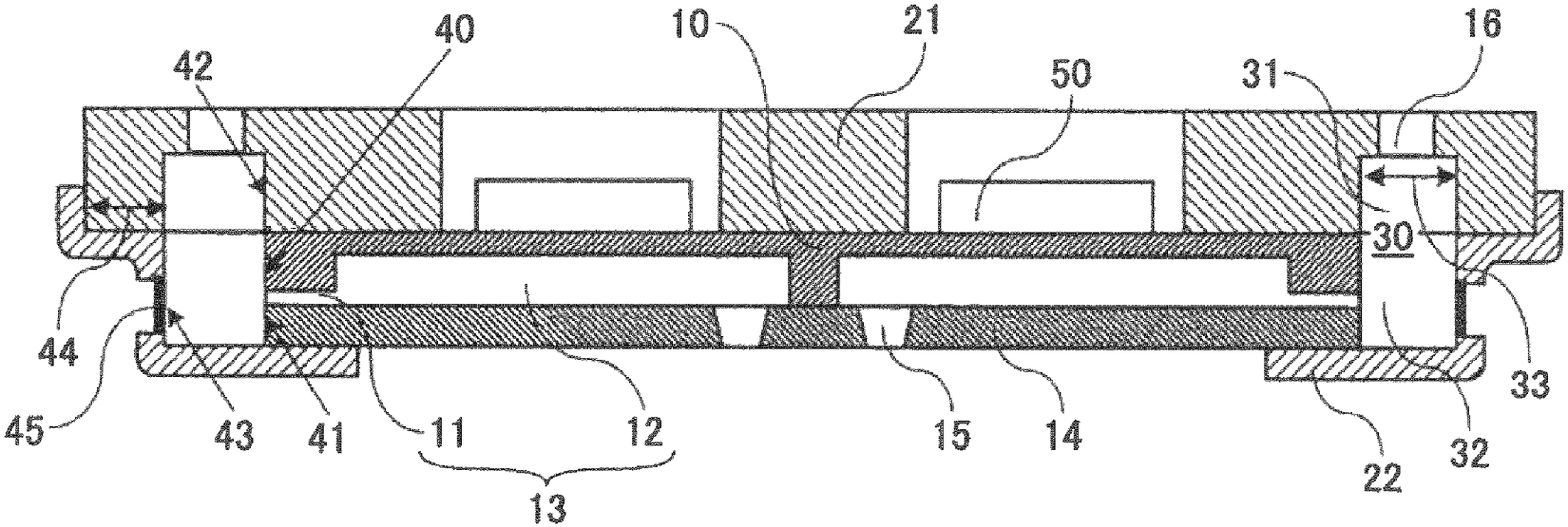
FIG. 6 is a cross-sectional view of the inkjet printer head according to yet another embodiment of the present invention.

FIG. 6 is a cross-sectional view of the inkjet printer head according to yet another embodiment of the present invention. FIG. 6 shows a modification of the second common liquid chamber forming member 22. In the modification of the second common liquid chamber forming member 22, a membrane 45 is disposed on the side surface of each common liquid chamber bottom part 32. The membranes 45, the common liquid chambers 30, the flow path resistance parts 11, and the pressure chambers 12 are serially arranged along the same plane, and therefore a pressure wave can be attenuated more efficiently than conventional cases.

Figure 7:
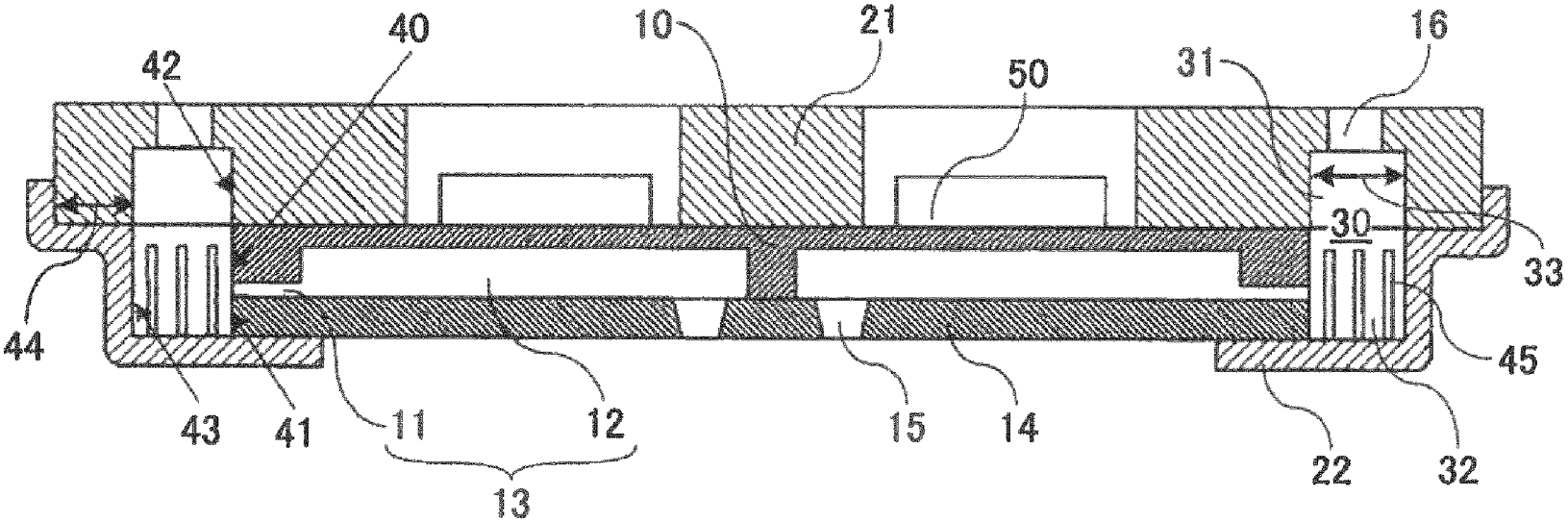
FIG. 7 is a cross-sectional view of the inkjet printer head according to yet another embodiment of the present invention.

FIG. 7 is a cross-sectional view of the inkjet printer head according to yet another embodiment of the present invention. Inside the common liquid chambers 30 of the inkjet printer head shown in FIG. 7, the membranes 45 are disposed in a direction orthogonal to the flow path including the flow path resistance parts 11. The membranes 45, the common liquid chambers 30, the flow path resistance parts 11, and the pressure chambers 12 are serially arranged along the same plane, and therefore a pressure wave can be attenuated more efficiently than conventional cases.

As described above, in the inkjet printer head according to an embodiment of the present invention, the common liquid chambers 30 and the flow path resistance parts 11 are directly communicating with each other. Therefore, the width of each of the flow path plates formed on a silicon wafer can be reduced. Accordingly, an increased number of flow path plates can be obtained from a silicon wafer, so that the inkjet printer head can be manufactured with a high yield ratio, and manufacturing costs can be reduced.

According to an embodiment of the present invention, a flow path resistance part is provided at the entrance of the flow path plate into which ink flows, and the flow path resistance part and the common liquid chamber are directly connected to each other on the same plane. Therefore, the width of the flow path plate can be reduced, and an increased number of flow path plates can be obtained from a silicon wafer.

According to an embodiment of the present invention, the inner wall of the common liquid chamber (the inner wall on the outer side of the common liquid chamber) is formed by a member other than the nozzle plate or the flow path plate. The member has a height that is substantially equal to a total thickness of the nozzle plate and the flow path plate. Therefore, the width of the flow path plate can be reduced.

According to an embodiment of the present invention, the outer wall of the flow path plate and the outer wall of the nozzle plate are on the same plane as the inner wall of the common liquid chamber, and the flow path resistance parts are formed at the outer wall of the flow path plate. Therefore, the width of the flow path plate can be reduced.

According to an embodiment of the present invention, the common liquid chamber, the flow path resistance parts, and the pressure chambers are aligned along the same plane, and the flow path resistance parts are formed at the outer wall of the flow path plate in such a manner as to be directly communicating with the common liquid chamber. Therefore, the width of the flow path plate can be reduced.

According to an embodiment of the present invention, attenuation of a pressure wave in the common liquid chamber can be efficiently performed, and crosstalk between nozzles can be mitigated.

The present invention is not limited to the specific embodiments described herein, and variations and modifications may be made without departing from the scope of the present invention.

The present application is based on Japanese Priority Patent Application No. 2009-143019, filed on Jun. 16, 2009, the entire contents of which are hereby incorporated herein by reference.

What is claimed is:

1. An inkjet printer head comprising:

a nozzle plate in which plural nozzles for jetting ink are formed;

a flow path plate in which flow paths for communicating with the plural nozzles are formed, each of the flow paths including a pressure chamber and a flow path resistance part having a smaller cross-sectional area than the pressure chamber, wherein piezoelectric elements are laminated on the flow path plate, each of the piezoelectric elements having an area that is less than or equal to a horizontal cross-sectional area of each of the flow paths; and a common liquid chamber configured to guide the ink from an ink supply opening to the pressure chamber, wherein the common liquid chamber is formed by a first common liquid chamber forming member and a second common liquid chamber forming member, the first common liquid chamber forming member forming a top part of the common liquid chamber, and the second common liquid chamber forming member forming a side surface and a bottom surface of a bottom part of the common liquid chamber by adhering to an outer wall of the first common liquid chamber forming member and to an ink jetting surface of the nozzle plate.

2. The inkjet printer head according to claim 1, wherein the second common liquid chamber forming member includes a first member that forms the side surface of the bottom part of the common liquid chamber and a second member that forms the bottom surface of the bottom part of the common liquid chamber, and the first member has a height that is substantially equal to a total thickness of the nozzle plate and the flow path plate that are laminated to each other.

3. The inkjet printer head according to claim 1, wherein each of the flow path resistance parts are disposed in the corresponding flow path in such a manner as to be directly communicating with the common liquid chamber.

4. The inkjet printer head according to claim 1, wherein the common liquid chamber is disposed at edge parts on either side of the nozzle plate and the flow path plate.

5. The inkjet printer head according to claim 1, wherein the common liquid chamber includes a membrane that is disposed in a direction orthogonal to the flow paths including the flow path resistance parts.

* * * * *